US007389856B2

(12) United States Patent
Irvin

(10) Patent No.: US 7,389,856 B2
(45) Date of Patent: Jun. 24, 2008

(54) ELEVATED WORK PLATFORM

(76) Inventor: Grady J. Irvin, 3914 Cedar Kay, Valrico, FL (US) 33594

( * ) Notice: Subject to any disclaimer, the term of this patent is extended or adjusted under 35 U.S.C. 154(b) by 528 days.

(21) Appl. No.: 10/899,208

(22) Filed: Jul. 26, 2004

(65) Prior Publication Data

US 2006/0016637 A1 Jan. 26, 2006

(51) Int. Cl.
*E04G 5/00* (2006.01)

(52) U.S. Cl. ..... 182/222; 182/119

(58) Field of Classification Search ..... 182/222, 182/223, 119, 178.1, 179.1
See application file for complete search history.

(56) References Cited

U.S. PATENT DOCUMENTS 2,751,258 A * 6/1956 Brattland ..... 182/186.16
3,094,848 A * 6/1963 Albrecht ..... 405/221
3,383,822 A * 5/1968 Vichmann et al. ..... 52/667
4,352,597 A * 10/1982 Kay ..... 405/219
4,522,009 A * 6/1985 Fingerson ..... 52/667
4,727,704 A * 3/1988 Carlton ..... 52/667
4,749,060 A * 6/1988 Vandelinde ..... 182/222
4,990,049 A * 2/1991 Hargrove ..... 414/537
5,815,870 A * 10/1998 Deutch et al. ..... 14/69.5

FOREIGN PATENT DOCUMENTS

DE 3832818 C1 * 12/1989

* cited by examiner

*Primary Examiner*—Alvin C Chin-Shue
(74) *Attorney, Agent, or Firm*—Arthur W. Fisher, III

(57) ABSTRACT

An elevated work platform to support workers thereon comprising a plurality of support sections held in operative relationship relative to each other by a peripheral frame wherein each support section comprises a plurality of transverse support members held in spaced relationship relative to each other by a plurality of longitudinal members and the peripheral frame comprises a pair of side frame members each including a channel to receive opposite end portions of the transverse support members of each support section to hold the support sections in operative position relative to the other support sections.

1 Claim, 7 Drawing Sheets

ELEVATED WORK PLATFORM

BACKGROUND OF THE INVENTION

1. Field of the Invention

The present invention relates to an elevated work platform or walkway to support workers or pedestrians above the ground or other surface.

2. Description of the Prior Art

There has been an unlimited number of catwalks, scaffolding structures, elevated work platforms and the like designed to support workers or pedestrians above the ground or other surface.

Many existing designs are intricate and complex; while others are heavy and cumbersome. In addition, most such support structures are constructed of wood or metal subject to deterioration due to prolonged exposure to the environmental elements.

Thus, there remains a need for a light weight, relatively expensive structure, not subject to the detrimental effects of the environment.

SUMMARY OF THE INVENTION

The present invention relates to an elevated work platform or walkway to support workers or pedestrians thereon above the ground of other surface. The elevated work platform may be affixed to poles adjacent a work area or otherwise supported in a work area such as on scaffolding. Of course, the elevated work platform can be used as a catwalk or other walkway.

The elevated work platform comprises at least one support section comprising a plurality of transverse support members held in spaced relationship relative to each other by a plurality of longitudinal section stabilizer members or bars.

Each transverse support member has a plurality of friction elements or particles affixed or adhered to the upper surface to engage the peripheral frame as described hereinafter. A plurality of apertures is formed through each transverse support member to receive a portion of the corresponding longitudinal section stabilizer members or bars therethrough.

The peripheral frame comprises a pair of side frame members disposed at opposite end portions of the transverse support members of each corresponding of support section.

Each side frame member comprises a channel or recess to receive opposite end portions of the transverse support members forcing the plurality of friction elements or particles against the interior of the corresponding channel or access to create a locking friction.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
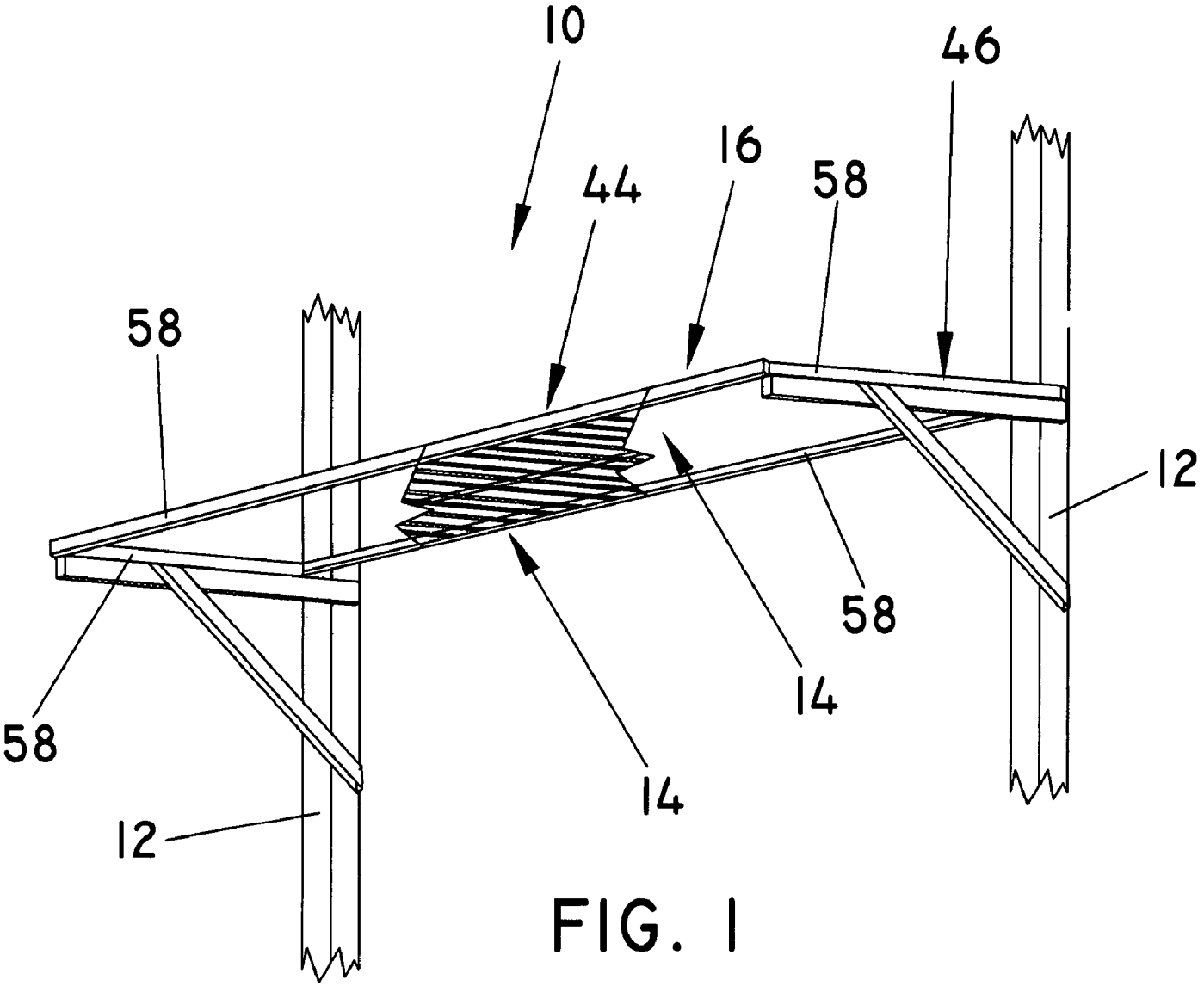
FIG. 1 is a perspective view of the elevated work platform of the present invention mounted on a pair of poles.
Figure 2:
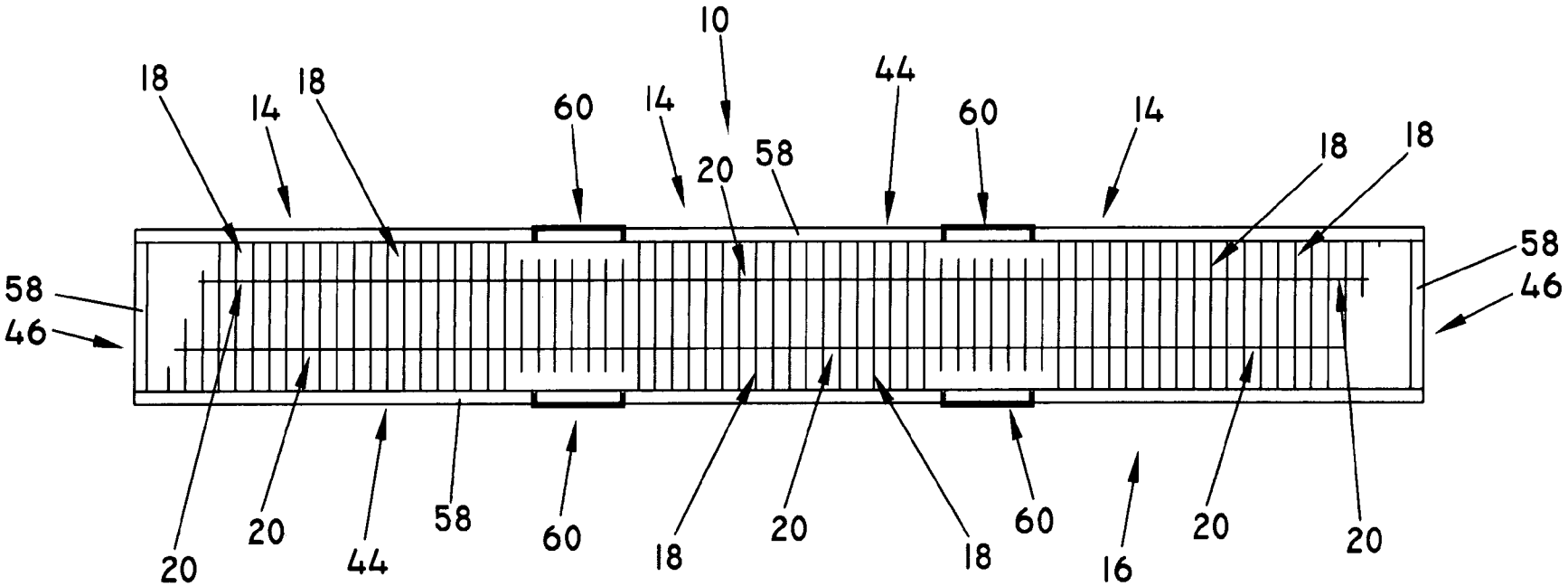
FIG. 2 is a top view of the elevated work platform of the present invention.
Figure 3:
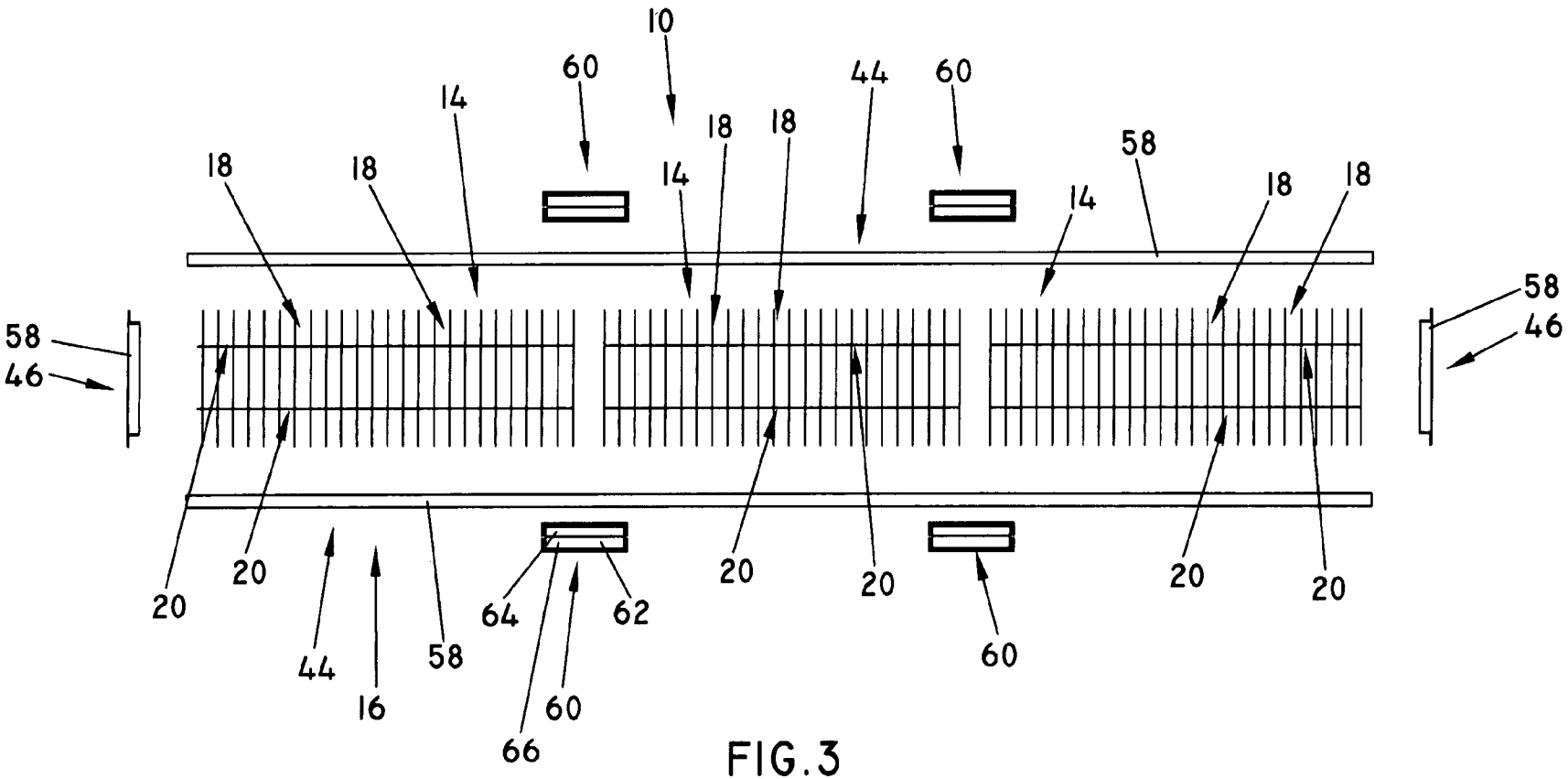
FIG. 3 is an exploded top view of the elevated work platform of the present invention.

As shown in FIGS. 1 through 3, the present invention relates to an elevated work platform or walkway generally indicated as 10 to support workers or pedestrians thereon above the ground or other surface. As shown in FIG. 1, the elevated work platform 10 may be affixed to poles 12 disposed adjacent a billboard sign or otherwise supported in a work area such as on scaffolding. Of course, the elevated work platform 10 can be used as a catwalk or other walkway. The elevated work platform or walkway 10 is preferably constructed of fiberglass or resins. Alternatively, other materials such as metal can be used.

As shown in FIGS. 1 through 3, the elevated work platform 10 comprises a plurality of support sections each generally indicated as 14 held in substantially coplanar relationship relative to each other by a peripheral frame generally indicated as 16.

Figure 4:
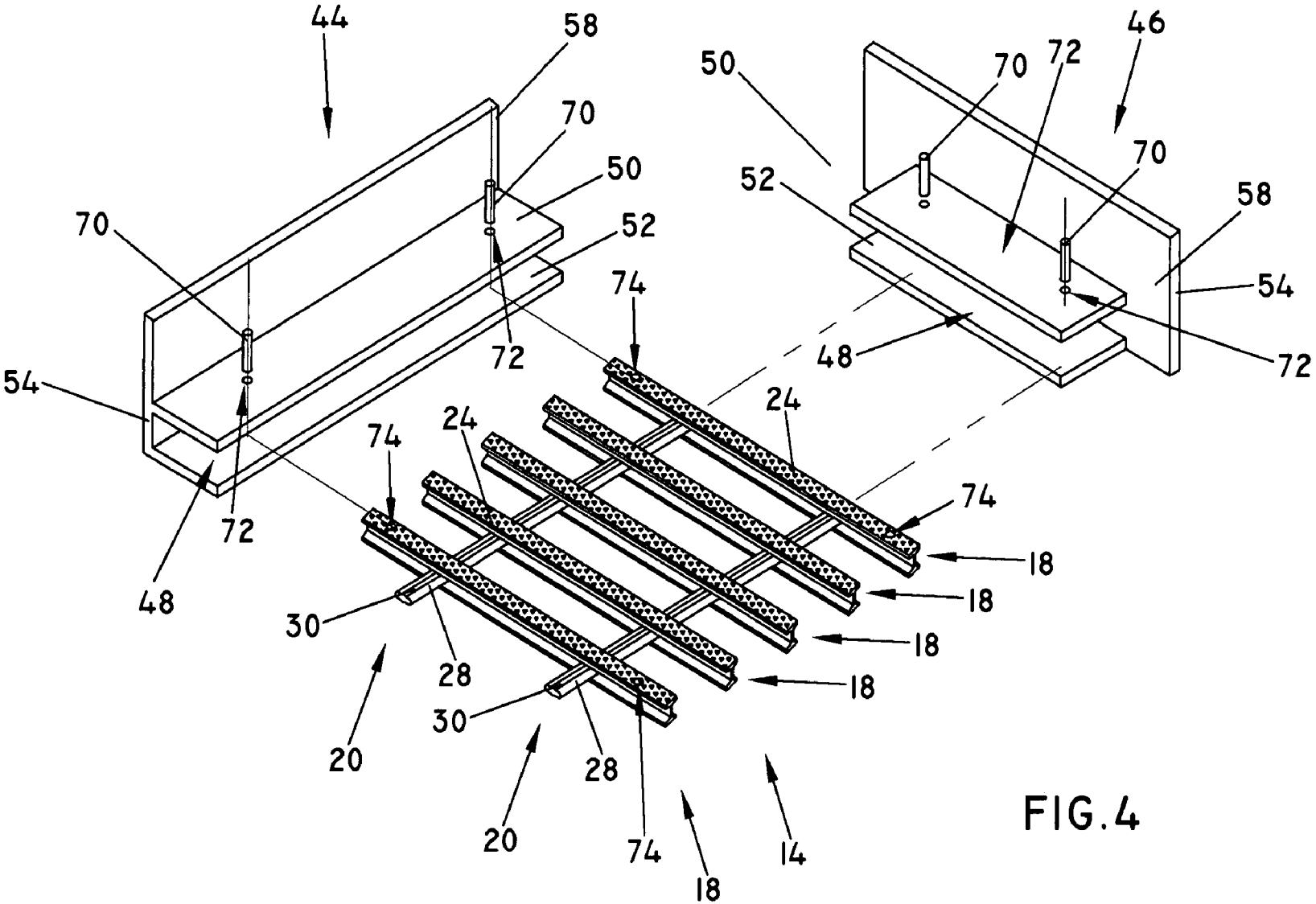
FIG. 4 is an exploded partial perspective view of the elevated work platform of the present invention.

As best shown in FIGS. 2 through 4, each support section 14 comprises a plurality of substantially rigid transverse support members each generally indicated as 18 held in substantially parallel relationship relative to each other by a plurality of substantially parallel, substantially rigid longitudinal section stabilizer members or bars each generally indicated as 20.

Figure 5:
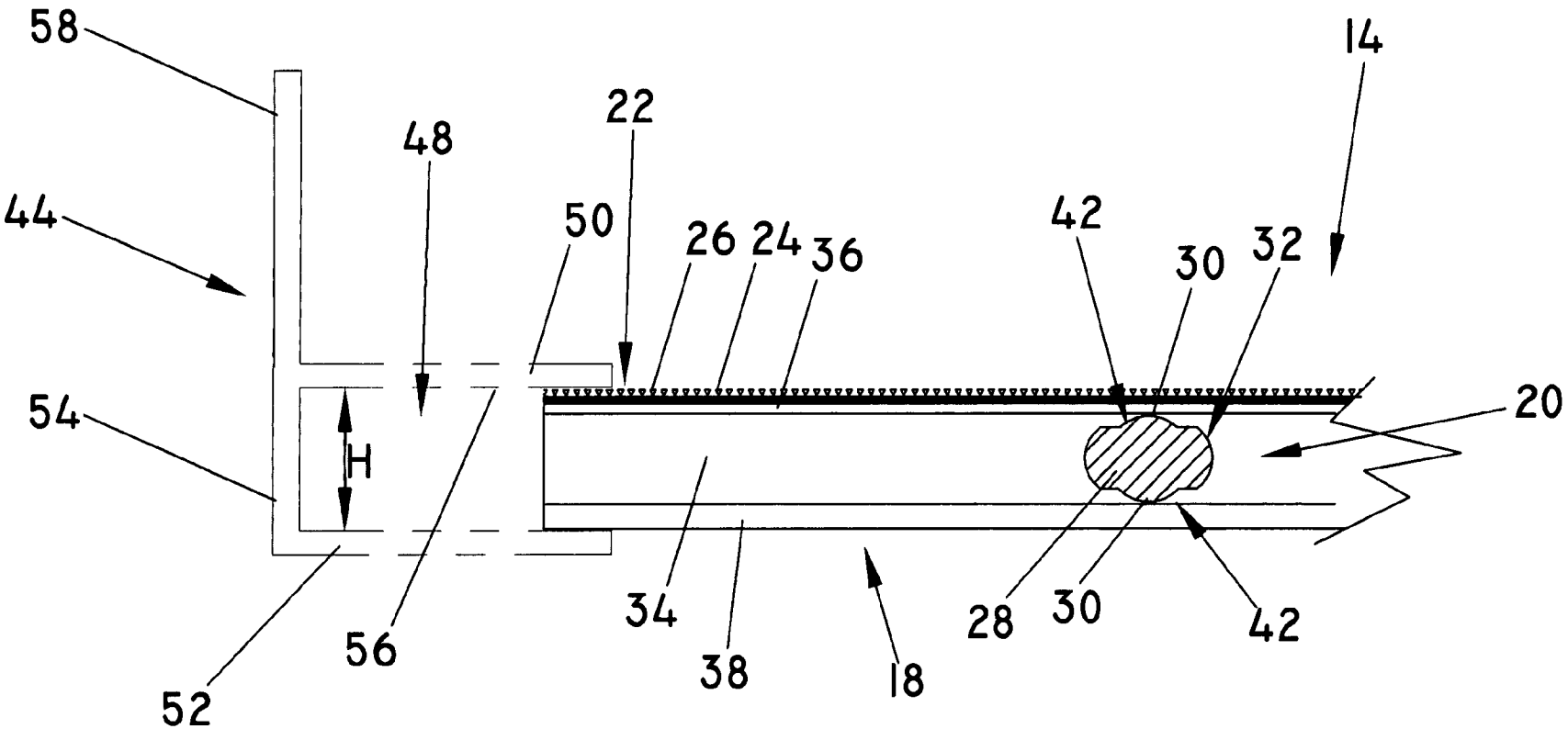
FIG. 5 is a partial detailed end view of the elevated work platform of the present invention.
Figure 6:
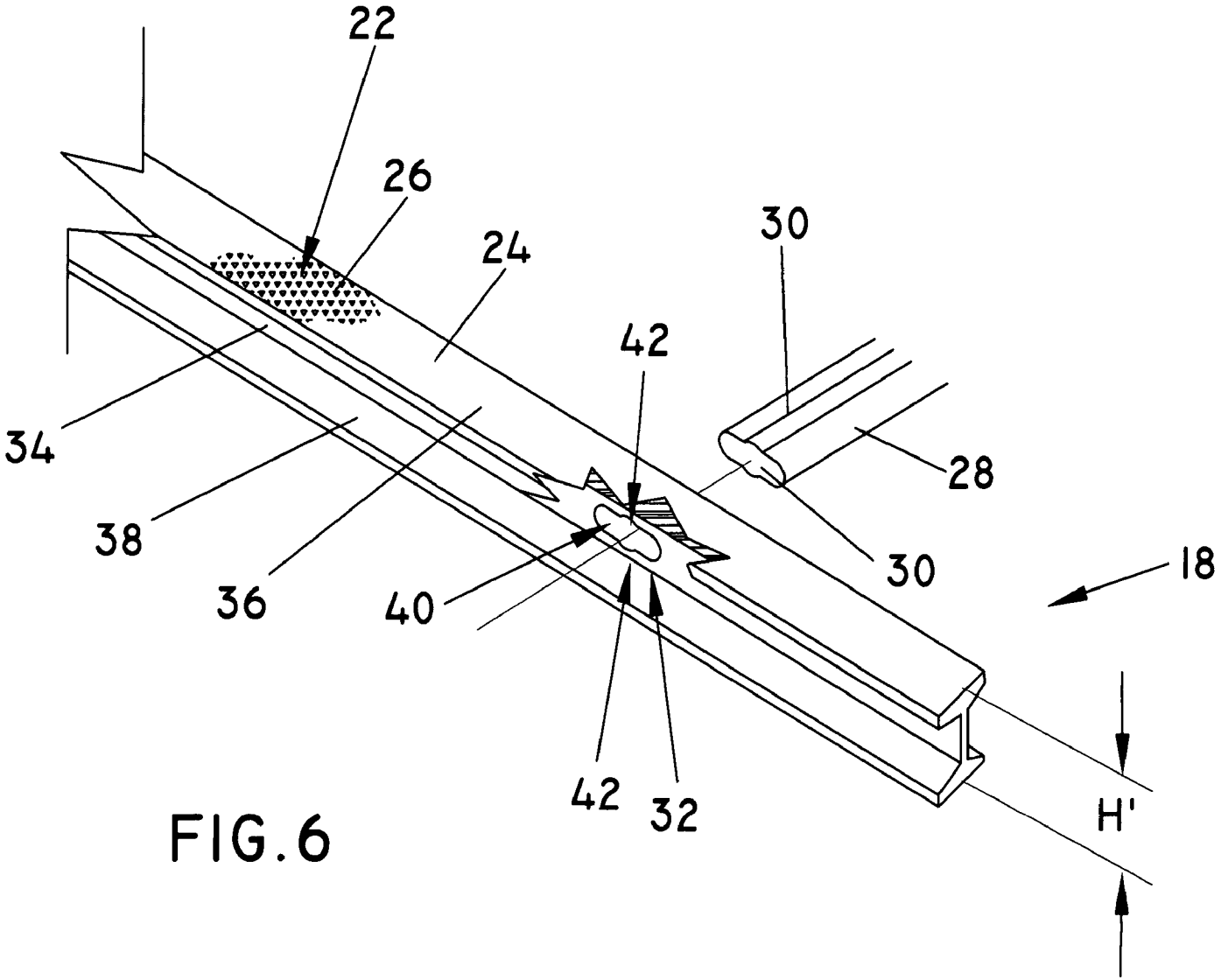
FIG. 6 is a partial perspective view of a support section of the elevated work platform of the present invention.
Figure 7:
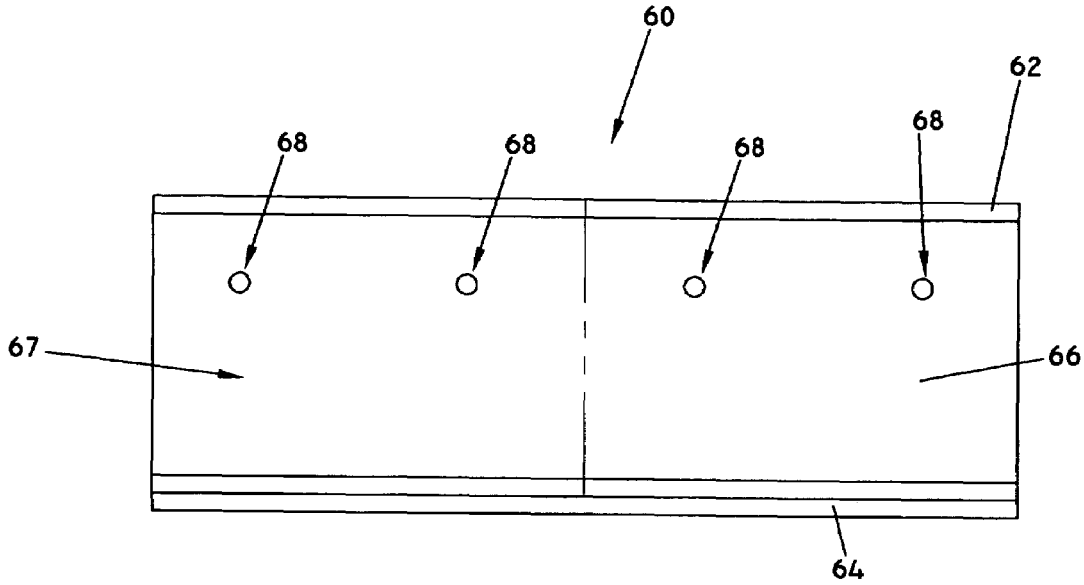
FIG. 7 is a front view of a side frame collar or brace of the elevated work platform of the present invention.

As best shown in FIGS. 4 through 6, each substantially rigid transverse support member 18 comprises an I-beam shape having a plurality of friction elements or particles generally indicated as 22 affixed or adhered to the upper surface 24 of the substantially rigid transverse support member 18 by a layer of epoxy resin 26. Of course, other suitable adhesives may be used. In addition, the plurality of friction elements or particles 22 may be impregnated into the upper surface 24 of the substantially rigid transverse support members 18. The plurality of friction elements or particles 22 extend above the upper surface of the layer of the epoxy resin 26 to cooperatively form a friction surface to retain the substantially rigid transverse support members 18 of the support sections 14 in operative engagement with the peripheral frame 16 as described hereinafter.

As best shown in FIGS. 4 through 6, each substantially rigid longitudinal section stabilizer member or bar 20 comprises a substantially oval center element 28 having a first and second convex element each indicated as 30 formed or affixed to opposite sides of the substantially oval center element 28. A plurality of apertures each indicated as 32 is formed through the center portion 34 of each substantially rigid transverse support member 18 between the upper and lower element indicated as 36 and 38 respectively of each substantially rigid transverse support member 18 to receive a portion of the corresponding substantially rigid longitudinal section stabilizer member or bar 20 therethrough.

Each aperture 32, configured similarly to the substantially rigid longitudinal sectional stabilizer members or bars 20, comprises a substantially oval center opening 40 having a first and second convex opening each indicated as 42 formed on opposite sides of each substantially oval center opening 40 of each aperture 32. So configured, the substantially rigid longitudinal sectional stabilizer members or bars 20 are aligned with corresponding apertures 32 of each rigid transverse support member 18 such that the substantially oval center element 28 of each substantially rigid longitudinal section stabilizer member or bar 20 extends through the corresponding substantially oval center opening 40 of each aperture 32, and the first and second convex elements 30 of each substantially rigid longitudinal section stabilizer member or bar 20 extend through the correspondingly first and second convex openings 42 of each aperture 32 whereby the periphery of the substantially rigid longitudinal section stabilizer member or bar 20 engages the periphery of corresponding apertures 32 to stabilize the substantially rigid transverse support members 18 of each corresponding support section 14 in operative alignment relative to each other. The substantially rigid longitudinal section stabilizer members or bars 20 may be bonded, welded, glued or otherwise affixed to the corresponding substantially rigid transverse support members 18.

As best shown in FIGS. 1 through 4, the peripheral frame 16 comprises a pair of substantially parallel, substantially rigid side frame members each generally indicated as 44 disposed at opposite end portions of the substantially rigid transverse support members 18 of each corresponding of support section 14 and a pair of substantially parallel, substantially rigid end frame members each generally indicated as 46 disposed at opposite end portions of the elevated work platform or walkway 10.

Figure 8:
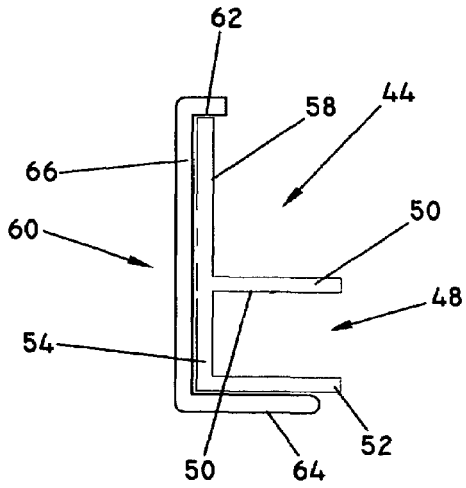
FIG. 8 is an end view of a side frame collar or brace of the elevated work platform of the present invention.

As best shown in FIGS. 4, 5 and 8, each substantially rigid side frame member 44 and each substantially rigid end frame member 46 comprises a channel or recess 48 cooperatively formed by a first channel or recess member 50 and a second channel or recess member 52 disposed in spaced relationship relative to each other by an interconnecting channel or recess member 54. The height h of each channel or recess 48 is substantially equally to or less than the height h' of the substantially parallel, substantially rigid transverse support members 18 such that opposite end portions of the substantially parallel, substantially rigid transverse support members 18 of each of the plurality of support sections 14 are press-fitted into the corresponding side channels or recesses 48 deflecting the first channel member 50 and forcing the plurality of friction elements or particles 22 against and/or into the inner surface 56 thereof to create a locking friction. Similarly, the outer end portion of the of outer support sections 14 are press-fitted into the end channels or recesses 48 of opposite substantially rigid end frame members 46 in a similar manner. A safety plate or guard 58 extends upwardly from each interconnecting channel or recess member 54 to prevent persons from accidentally stepping off the elevated work platform or walkway 10.

As best shown in FIGS. 2, 3, 7 and 8, a side frame collar or brace generally indicated as 60 is mounted on the substantially parallel, substantially rigid side frame members 44 to reinforce or brace the area between adjacent support sections 14. Each side frame collar or brace 60 comprises a first brace member 62 and a second brace member 64 held in substantially parallel spaced relationship relative to each other by an interconnecting brace member 66 to cooperatively form a side frame receiving channel or recess 67 therebetween to receive the corresponding substantially parallel, substantially rigid side frame member 44 therein. Specifically, the safety plates or guards 58 of each substantially parallel, substantially rigid side frame members 44 are disposed between the first brace member 62 and the second brace member 64 of the corresponding side frame collars or braces 60 held in place by a corresponding plurality of fasteners (not shown) extending through holes or apertures 68. Of course, the collars or braces 60 can be glued or otherwise bonded to the corresponding substantially parallel, substantially rigid side frame member 44.

As shown in FIG. 4, a plurality of slip pins each indicated as 70 may be disposed within a corresponding plurality of apertures each indicated as 72 formed through first channel members 50 of the substantially rigid side frame members 44 and the substantially rigid end frame members 46 and corresponding apertures each indicated as 74 formed in each substantially rigid transverse support member 18 and in operative alignment with the corresponding apertures 72.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An elevated work platform or walkway to support at least one person thereon comprising a support section including a plurality of substantially rigid transverse support members held in spaced relationship relative to each other by a plurality of substantially rigid longitudinal section stabilizer members and a peripheral frame including a pair of substantially rigid side frame members each comprising a channel to receive opposite end portions of said substantially rigid transverse support members, each said substantially rigid side frame member comprises an inverted substantially F shaped member including a first channel member and a second channel member disposed in spaced relationship relative to each other by an interconnecting channel member to cooperatively form said channel therebetween and a safety guard extending upwardly from said interconnecting channel member to prevent persons from stepping off either side of said elevated work platform or walkway, said peripheral frame further comprises a pair of substantially rigid end frame members disposed at opposite end portions of said elevated work platform or walkway, each said substantially rigid end frame member comprising an inverted substantially F shaped member including a first channel member and a second channel member disposed in spaced relationship relative to each other by an interconnecting channel member to cooperatively form said channel therebetween and a safety guard extending upwardly from said interconnecting channel member to prevent persons from stepping off either end of said elevated work platform or walkway, wherein the height of each said channel of each said substantially rigid side frame member is substantially equally to or less than the height of opposite end portions of said substantially rigid transverse support members such that said substantially rigid transverse support member of said support section of opposite end portions of said elevated work platform or walkway are press-fitted into the corresponding end channels and each substantially rigid transverse support member includes a plurality of friction elements disposed on the upper surface thereof to cooperatively form a friction surface to retain said substantially rigid transverse support members in operative engagement with said peripheral frame, said elevated work platform comprises a plurality of support sections held in substantially coplanar relationship relative to each other by said peripheral frame, wherein a brace is mounted on each said side substantially rigid side frame member to reinforce the area between adjacent support sections, each said brace comprises a C-shaped configuration including a upper brace member and a lower brace member held in substantially parallel spaced relationship relative to each other by an interconnecting vertical brace member to cooperatively form a frame receiving channel therebetween to receive the corresponding substantially rigid side frame member therein, wherein said upper brace member extends a shorter distance from the interconnecting vertical brace member than said lower brace member and engaging over a top end of said safety guard and a free end of the upper brace member being substantially aligned with an inner face of said safety guard, wherein said substantially rigid transverse support members each have a plurality of apertures formed therethrough to receive corresponding substantially rigid longitudinal section stabilizer members wherein said apertures are configured similarly to said substantially rigid longitudinal section stabilizer members maintain said substantially rigid longitudinal section stabilizer members in operative alignment relative to each other and wherein said apertures each comprise a substantially oval center opening and said substantially rigid longitudinal section stabilizer each comprises a substantially oval center element, wherein each said substantially rigid longitudinal section stabilizer member further comprises a first and second convex element formed on opposite sides of said substantially oval center element and wherein each said aperture further comprises a first and second convex opening on opposite sides of each said substantially oval center opening and wherein said substantially rigid longitudinal section stabilizer members are aligned with the corresponding apertures of each said substantially rigid transverse support member such that said substantially oval center elements of each said substantially rigid longitudinal sections stabilizer member extends through the corresponding substantially oval center opening of each said aperture and said first and second convex elements of each said substantially rigid longitudinal section stabilizer member extend through the correspondingly first and second convex openings of each said aperture whereby the periphery of the substantially rigid longitudinal section stabilizer member engages the periphery of the corresponding apertures to stabilize said substantially rigid transverse support members of said support section wherein a plurality of slip pins are disposed within a corresponding plurality of apertures formed through said first channel members of said substantially rigid side frame members and said first channel member of each said substantially rigid end frame member and corresponding apertures formed in each said substantially transverse support member in operative alignment with the corresponding apertures of the first channel members such that said slip pins are disposed perpendicular relative to the longitudinal axis or of said substantially rigid side frame member supported on the corresponding second channel member.

* * * * *